US005435935A

United States Patent [19]

Kupneski

[11] Patent Number: 5,435,935

[45] Date of Patent: Jul. 25, 1995

[54] ALKALINE LIQUID HARD-SURFACE CLEANING COMPOSITION CONTAINING A QUARTERNARY AMMONIUM DISINFECTANT AND SELECTED DICARBOXYLATE SEQUESTRANTS

[75] Inventor: Michael J. Kupneski, Cincinnati, Ohio

[73] Assignee: The Procter & Gamble Company, Cincinnati, Ohio

[21] Appl. No.: 155,985

[22] Filed: Nov. 22, 1993

[51] Int. Cl.[6] ..... C11D 1/04; C11D 1/08

[52] U.S. Cl. ..... 252/156; 252/158; 252/106; 252/DIG. 10; 252/DIG. 11

[58] Field of Search ..... 252/156, 158, DIG. 10, 252/DIG. 11, 106

[56] References Cited

U.S. PATENT DOCUMENTS

| | | | |
|---|---|---|---|
| 3,887,497 | 6/1975 | Ulvid | 252/526 |
| 3,997,460 | 12/1976 | Sirine et al. | 252/106 |
| 4,021,376 | 5/1977 | Lamberti et al. | 252/542 |
| 4,252,665 | 2/1981 | Casey et al. | 252/106 |
| 4,443,363 | 4/1984 | Klinger et al. | 252/547 |
| 4,581,161 | 4/1986 | Nedonchelle | 252/550 |
| 4,613,448 | 9/1986 | Cheng | 252/157 |
| 4,680,131 | 7/1987 | Busch et al. | 252/102 |
| 4,725,489 | 2/1988 | Jones et al. | 428/289 |
| 5,008,030 | 4/1991 | Cook et al. | 252/106 |
| 5,110,492 | 5/1992 | Casey | 252/90 |
| 5,244,666 | 9/1993 | Murley | 424/405 |
| 5,290,472 | 3/1994 | Michael | 252/170 |
| 5,336,445 | 8/1994 | Michael et al. | 252/548 |

*Primary Examiner*—Linda Skaling
*Assistant Examiner*—Michael Tierney
*Attorney, Agent, or Firm*—William J. Winter; Rose Ann Dabek; J. C. Rasser

[57] ABSTRACT

Disclosed is a alkaline liquid hard-surface cleaning and disinfecting composition. The composition comprises from about 0.001% to about 15% by weight of a $C_4$–$C_7$ dicarboxylate or hydroxydicarboxylate, from about 0.005% to about 10% by weight of a quaternary ammonium disinfectant, from about 0.001% o about 15% by weight of a detergent surfactant, a pH of from about 8.5 to about 13, from about 15% to 98% by weight of water, and from 0 to about 20% by weight of an organic solvent having a hydrogen bonding parameter of less than about 7.7. The composition can be used to provide streak-free cleaning and disinfecting of hard surfaces. Moreover, in the presence of the selected dicarboxylates, the quaternary ammonium disinfectant retains its disinfectancy properties and does not precipitate out of solution. The composition can be prepared as a dry formulation.

14 Claims, No Drawings

ALKALINE LIQUID HARD-SURFACE CLEANING COMPOSITION CONTAINING A QUARTERNARY AMMONIUM DISINFECTANT AND SELECTED DICARBOXYLATE SEQUESTRANTS

FIELD OF THE INVENTION

This invention relates to a stable, alkaline liquid hard-surface cleaning composition which contains a quaternary ammonium disinfectant and selected dicarboxylate sequestrants.

BACKGROUND OF THE INVENTION

Alkaline liquid hard-surface cleaning compositions, including those which contain hard water sequestrants, are well known. The alkalinity provides improved grease cleaning properties but often necessitates the use of sequestrants. In alkaline compositions, divalent cations, e.g., $Mg^{++}$, $Ca^{++}$, react with carbonates and other anionic species in hard water and form solid precipitates. These precipitates can form on hard surfaces thus appearing as a visible film, or within alkaline concentrates when diluted with hard tap water prior to use. Sequestrants (e.g., phosphates, EDTA, polycarboxylates) are incorporated into alkaline hard-surface cleaning compositions to help prevent formation of these insoluble salts. The sequestrants bind to the hard water cations to thus prevent the formation of insoluble hard water precipitates.

Acidic liquid, hard-surface cleaning and disinfecting compositions are also well known. These compositions are commonly used to clean and disinfect hard bathroom surfaces. Unlike alkaline compositions, these acidic compositions can contain quaternary ammonium disinfectants. Quaternary ammonium disinfectants are not typically compatible with hard water sequestrants in alkaline compositions. Acidic compositions do not require a sequestrant since divalent hard water cations do not readily form solid precipitates in acidic environments, e.g., there are insufficient amounts of anionic species in the acidic compositions to react with the divalent cations to form solid precipitates. Without sequestrants in the compositions, quaternary ammonium disinfectants can be more easily incorporated into the acidic hard-surface cleaning compositions. However, the quaternary ammonium disinfectant contributes to filming and streaking, and acidic compositions are less effective than alkaline compositions in cleaning greasy dirt.

Given the forgoing, there is a need to provide a stable, alkaline liquid hard-surface cleaning composition which contains both a quaternary ammonium disinfectant and a sequestrant. It is therefore an object of the present invention to provide such a composition. It is a further object to provide such a composition which also does not cause filming or streaking on hard surfaces.

SUMMARY OF THE INVENTION

The present invention relates to an alkaline liquid hard-surface cleaning composition comprising from about 0.001% to about 15% by weight of a $C_4$ to $C_7$ dicarboxylate sequestrant; from about 0.005% to about 10% by weight of a quaternary ammonium disinfectant; from about 0.001% to about 15% by weight of a zwitterionic, nonionic or cationic detergent surfactant, or a mixture thereof; a pH of from about 8.5 to about 13; from about 15% to about 98% by weight of water; and from 0 to about 20% by weight of an organic solvent having a hydrogen bonding parameter of less than about 7.7. The composition can be used to provide streak-free cleaning and disinfecting of hard surfaces. The quaternary ammonium disinfectant is neither inactivated nor precipitated by the selected dicarboxylate sequestrants. It is well known that quaternary ammonium disinfectants are not normally compatible with sequestrants in alkaline hard-surface cleaners and that such disinfectants and sequestrants cause excessive filming and streaking of hard surfaces.

All ratios, parts and percentages herein are based on weight unless otherwise specified.

DETAILED DESCRIPTION OF THE INVENTION

The alkaline liquid hard-surface cleaning composition of the present invention contains a unique combination of a quaternary ammonium disinfectant and a selected dicarboxylate sequestrant.

Sequestrant

Surprisingly, the selected dicarboxylate sequestrants for use in the alkaline liquid composition of the present invention do not precipitate or inactivate quaternary ammonium disinfectants. We tested mono-, di- and tricarboxylates, and well-known sequestrants (e.g., phosphates, EDTA, DTPA, polycarboxylate polymers) for sequestering ability and compatibility with quaternary ammonium disinfectants in alkaline compositions. Only the $C_4$–$C_7$ dicarboxylates, described herein, exhibited good sequestering properties and were chemically stable in the presence of a quaternary ammonium disinfectant in an alkaline composition.

To demonstrate the compatibility of the selected dicarboxylate sequestrants herein with quaternary ammonium disinfectants, the following tests were conducted. Several alkaline solutions (pH 9.8) were prepared, each having the following formula but a different "Test Material" (see Table 1 for description of Test Materials).

| Ingredient | wt. % |
|---|---|
| Isopropanol | 30 |
| Butoxypropanol | 15 |
| Monoethanolamine | 2.5 |
| $C_{10}$–$C_{14}$ fatty acyl-amidopropylene (hydroxpropylene) sulfobetaine | 0.8 |
| Mixture of n-alkyl dimethyl ethylbenzyl ammonium chloride and n-alkyl dimethyl benzyl ammonium chloride | 0.5 |
| Test Material | 0.1 |
| Water | q.s. |

About 100ml of each alkaline solution was diluted with 400ml of 14 gpg (grain per gallon) tap water, heated to 120° F. for up to 72 hours, and visually observed for precipitate formation (all observed precipitates actually occurred within about five hours). The particular alkaline solutions identified with an (*) in Table 1 were associated with hard water precipitates only, e.g., the Test Material was compatible with the quaternary ammonium compound but could not sequester hard water cations. All other precipitates observed during testing were largely due to incompatibility between the Test Material and the quaternary ammonium disinfectant in the alkaline solution. Test results are set forth below in Table 1.

TABLE 1

| Alkaline solution identified by Test Material therein | Precipitation within 72 hr at 120° F. |
|---|---|
| Monocarboxylic Acids | |
| Butanoic acid $CH_3(CH2)_2CO_2H$ | Yes* |
| Pentanoic acid $CH3(CH_2)_3CO_2H$ | Yes* |
| Hexanoic acid $CH_3(CH_2)_4CO_2H$ | Yes* |
| Octanoic acid $CH_3(CH_2)_6CO_2H$ | Yes* |
| Dicarboxylic Acids Compatible with Quaternary Ammonium Disinfectant | |
| Butanedioic (Succinic) Acid $CO_2H(CH_2)_2CO_2H$ | No |
| Pentanedioic (glutaric) acid $CO_2H(CH_2)_3CO_2H$ | No |
| Hexanedioic (adipic) acid $CO_2H(CH)_4CO_2H$ | No |
| 1,7-hepatanedioic (pimelic) acid $CO_2H(CH_2)_5CO_2H$ | No |
| Carboxylic Acids not Compatible with Quaternary Ammonium Disinfectant | |
| Methanedicarbonic(malonic acid) $CO_2HCH_2CO_2H$ | Yes |
| Octanedioic acid (suberic) acid $CO_2H(CH_2)_6CO_2H$ | Yes |
| 1,7-heptanedicarboxylic (azelaic acid) $CO_2H(CH_2)_7CO_2H$ | Yes |
| 2-hydroxy-1,2,3-propane- tricarboxylic (citric) acid $CO_2HCH_2C(OH)(CO_2H)CH_2CO_2H$ | Yes |
| Other Sequestrants not Compatible with Quaternary Disinfectant | |
| Sodium tripolyphosphate (STPP) | Yes |
| Potassium tripolyphosphate (KTPP) | Yes |
| Phosphonate | Yes |
| Ethylendiaminetriacetic acid (EDTA) | Yes |
| Diethylenediaminetriacetic acid (DTPA) | Yes |
| *Sokalan ® -CP9 | Yes |
| Polyacrylate (avg. MW 1000) | Yes |

*polycarboxylate copolymer, available from BASF Corp., Parsippany, NJ.

As shown in Table 1, only the $C_{4l-C7}$ dicarboxylates sequestered hard water cations and were compatible with the quaternary ammonium disinfectant. Although the monocarboxylates were compatible with the quaternary ammonium disinfectant, they did not sequester hard water cations. All other Test Materials formed solid precipitates with the quaternary ammonium disinfectants, these other Test Materials included $C_3$, $C_8$ and $C_9$ dicarboxylates; tricarboxylates (citric acid); phosphates; EDTA and DTPA; and polycarboxylate polymers (Sokalan ®-CP9, polyacrylate).

The alkaline liquid composition of the present invention comprises from about 0.001% to about 15%, preferably from about 0.01% to about 2.5%, more preferably from about 0.02% to about 0.5%, by weight of a sequestrant having the formula:

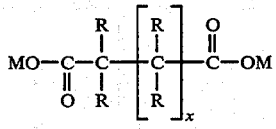

wherein each R group is hydrogen or a hydroxyl group, preferably a hydroxyl group; each M is hydrogen, ammonium, substituted ammonium or an alkali metal; and X is a number from 1 to 4. The basic dicarboxylate structure thus contains from 4 to 7 carbon atoms. Such dicarboxylates include, for example, succinate, tartrate, glutarate, and saccharate. The most preferred dicarboxylate for use in the composition is tartrate.

While not intended to be bound by theory, it is believed that the $C_{4-7}$ dicarboxylates may be uniquely suited for selective sequestration of divalent cations over quaternary ammonium groups because of their structure. The dicarboxylate is allowed to bond at two active sites on a divalent cationic species thus forming a closed ring structure which is more stable than two single bond affiliations with two separate quaternary species. Thus, there is a preference for divalent cations over monovalent cationic species.

The alkaline liquid hard-surface cleaning composition herein can be applied directly to hard surfaces or diluted prior to use with an aqueous liquid, e.g., hard or deionized water. Even when diluted with hard tap water, the alkaline composition herein remains stable for prolonged periods. Most dilutable hard-surface cleaners are diluted just prior to the point of use and are not thereafter stored for extended periods. During storage of most diluted alkaline compositions, calcium and magnesium salts form insoluble species with carbonates and other anionic species found in the hard water (e.g., at least about 5 gpg) diluents. The dicarboxylate sequestrants described herein help keep the alkaline composition precipitate-free for up to about 12 months at temperatures ranging from about 40° F. (4° C.) to about 100° F. (38° C.).

Quaternary Ammonium Disinfectant

The composition of the present invention comprises a quaternary ammonium disinfectant. Suitable quaternary ammonium compounds are those known in the detergency art for topical application to hard surfaces.

The preferred quaternary ammonium disinfectant has the formula

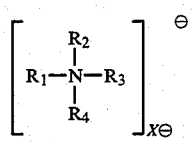

wherein $R_1$ is a substituted or unsubstituted alkyl or alkylene group containing from about 8 to about 20 carbon atoms, preferably from about 12 to about 18 carbon atoms; $R_2$, $R_3$ and $R_4$ are each selected from the group of substituted or unsubstituted alkyl or alkylene groups containing from 1 to 4 carbon atoms and benzyl groups, there being normally no more than one benzyl group. Two of the $R_2$, $R_3$ and $R_4$ groups can be joined by either a carbon-carbon ether, or imino linkage to form a ring structure. X is a halogen atom, sulfate group, nitrate group or other pseudohalogen group.

Preferred quaternary ammonium disinfectants are N-alkyl ($C_{12}$–$C_{18}$) benzyl dimethyl ammonium chloride, N-alkyl ($C_{12}$–$C_{18}$) dimethyl ethylbenzyl ammonium chloride, and di- N-alkyl ($C_8$–$C_{10}$) dimethyl ammonium chloride.

Detergent Surfactant

The alkaline liquid composition of the present invention comprises a detergent surfactant selected from the group of zwitterionic, nonionic and cationic detergent surfactants, and mixtures thereof. Surfactants within these general classes are well known in the detergency art for use in hard-surface cleaning compositions. The composition herein will typically comprise from about 0.05% to about 10%, preferably from about 0.25% to about 3%, more preferably from about 0.5% to about 3%, by weight of the detergent surfactant. The concentration of the detergent surfactant will depend of course upon the type of surfactant and whether the composition is a concentrate (e.g., suitable for dilution prior to use) or a ready-to-use formulation.

a. Zwitterionic surfactant

The composition preferably comprises a zwitterionic surfactant. The zwitterionic surfactant contains a cationic group, preferably a quaternary ammonium group, and an anionic group, preferably a carboxylate, sulfate and/or sulfonate group, more preferably a sulfonate group. The zwitterionic surfactant will thus contain both a cationic group and an anionic group and will be in substantial electrical neutrality where the number of anionic charges and cationic charges on the surfactant molecule are substantially the same. These zwitterionic surfactants are desirable since they maintain their amphoteric character over most of the pH range of interest for cleaning hard surfaces. Some zwitterionic surfactants useful in the composition herein are described in U.S. Pat. No. 5,108,660, which description is incorporated herein by reference.

A preferred zwitterionic surfactant for use in the composition is a hydrocarbyl-amidoalkylenesulfobetaine having the formula:

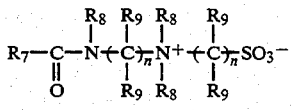

wherein $R_7$ is an alkyl group containing from about 8 to about 20, preferably from about 10 to about 18, more preferably from about 12 to about 16 carbon atoms, each $R_8$ is either hydrogen or a short chain alkyl or substituted alkyl containing from 1 to about 4 carbon atoms, preferably groups selected from the group of methyl, ethyl, propyl, hydroxy substituted ethyl or propyl and mixtures thereof, preferably methyl, each $R_9$ is selected from the group of hydrogen and hydroxy groups, and each "n" is a number from 1 to about 4, preferably from 2 to about 3, more preferably about 3, with no more than about one hydroxy group in any $C(R_9)_2$ moiety. The $R_7$ groups can be branched and/or unsaturated, and such structures can provide spotting-/filming benefits, even when used as part of a mixture with straight chain alkyl $R_7$ groups. The $R_8$ groups can also be connected to form ring structures.

Preferred hydrocarbyl-amidoalkylenesulfobetaine detergent surfactants include the $C_{10}$–$C_{14}$ fatty acyl-amidopropylene (hydroxypropylene) sulfobetaines, e.g. the detergent surfactant available from the Sherex Company under the tradename "Varion CAS Sulfobetaine". Also preferred is cocoamido-propylbetaine, e.g., the detergent surfactant available from the Sherex Company under the Tradename "Varion CADG Betaine".

Other suitable zwitterionic detergent surfactants are described at Col. 4 of U.S. Pat. No. 4,287,080, and in U.S. Pat. No. 4,557,853, both of which are incorporated herein by reference.

b. Nonionic Surfactant

Suitable nonionic surfactants for use in the composition include alkylene oxide condensates, amides and semi-polar nonionics. A description of these surfactants is set forth at Col. 6–9 in U.S. Pat. No. 4,287,080, which description is incorporated herein by reference.

Alkylene oxide condensates for use in the composition are broadly defined as compounds produced by the condensation of alkylene oxide groups (hydrophilic in nature) with an organic hydrophobic compound, which can be aliphatic or alkyl aromatic in nature. The length of the hydrophilic or polyoxyalkylene radical which is condensed with any particular hydrophobic group can be readily adjusted to yield a water-soluble compound having the desired degree of balance between hydrophilic and hydrophobic elements.

Amide type nonionic surfactants for use in the composition include the ammonia, monoethanol and diethanol amides of fatty acids having an acyl moiety of from about 7 to about 18 carbon atoms. These acyl moieties are normally derived from naturally occurring glycerides, e.g., coconut oil, palm oil, soybean oil and tallow, but can be derived synthetically, e.g., by the oxidation of petroleum, or by the Fischer-Tropsch process.

Semi-polar nonionic surfactants for use in the composition include amine oxides, phosphine oxides and sulfoxides. The amine oxide surfactant preferably has the general formula [RR'R''N→O] where R is an alkyl group containing from about 10 to about 28 carbon atoms, preferably from about 10 to about 16 carbon atoms; and R' and R'' are each selected from the group of alkyl, alkylene, hydroxyalkyl, and hydroxyalkylene radicals containing from 1 to about 3 carbon atoms. Other suitable amine oxides are described in U.S. Pat. No. 4,470,923, which description is incorporated herein by reference. Suitable phosphine oxide nonionic surfactants will typically contain one alkyl or hydroxyalkyl moiety of 8 to 28 carbon atoms, preferably 8 to 16 carbon atoms and 2 alkyl moleties selected from the group of alkyl and hydroxyalkyl groups containing from 1 to 3 carbon atoms. Suitable sulfoxides will typically contain one alkyl or hydroxyalkyl moiety of 8 to 18 carbon atoms and one alkyl moiety selected from the group of alkyl and hydroxyalkyl groups having 1 to 3 carbon atoms.

c. Cationic surractant

Suitable cationic surfactants for use in the composition, in addition to the quaternary ammonium disinfectants described hereinbefore, are those containing a hydrophobic group (or, less preferably, two hydrophobic groups, if they are shorter, e.g., from about 8 to about 10 carbon atoms), typically containing an alkyl group in the C8–C18 range, and, optionally, one or more groups such as ether or amido, preferably amido groups which interrupt the hydrophobic group.

Solvent

The composition of the present invention is an alkaline liquid which comprises from about 15% to 98% by weight of water and from 0 to 20% by weight of an organic solvent. The composition preferably comprises from about 25% to about 95%, more preferably from about 45% to about 90% by weight of water, and from about 1% to about 20%, more preferably from about 5% to about 10% by weight of organic solvent.

The organic solvents herein are defined in terms of hydrogen bonding parameters, a solubility parameter as set forth in "The Hoy," a publication of Union Carbide, incorporated herein by reference. Hydrogen bonding parameters are calculated using the formula $$\gamma H = \gamma T \frac{\alpha - 1}{\alpha}\ ^{\frac{1}{2}}$$

wherein $\gamma H$ is the hydrogen bonding parameter, $\alpha$ is the aggregation number, $$\left(\text{Log } \alpha = 3.39066\ T_b/T_c - 0.15848 - \text{Log } \frac{M}{d}\right),$$

$\gamma T$ is the solubility parameter which is obtained from the formula $$\gamma T = \frac{(\Delta H_{25} - RT)d}{M}^{\frac{1}{2}}$$

where $\Delta H_{25}$ is the heat of vaporization at 25° C. (77° F.), R is the gas constant (1.987 cal/mole/deg., T is the absolute temperature in ° K., $T_b$ is the boiling point in ° K., $T_c$ is the critical temperature in ° K., d is the density in grams/ml, and M is the molecular weight.

The organic solvent for use in the composition herein has hydrogen bonding parameters preferably less than about 7.7, more preferably from about 2 to about 7, and even more preferably from about 3 to about 6. Solvents with lower numbers become increasingly difficult to solubilize in the composition and have a greater tendency to leave a visible residue on shiny surfaces. Higher numbers require more solvent to provide good cleaning of greasy soil.

The organic solvent preferably comprises monoethanolamine and/or beta-aminoalkanols. These preferred organic solvents help reduce spotting and filming of hard surfaces. Monoethanolamine and beta-aminoalkanols serve primarily as solvents when the pH of the composition is above about 11.0, and especially above 11.7. The composition herein preferably comprises from about 0.05% to about 10%, more preferably from about 0.05% to about 5%, by weight of monoethanolamine and/or beta-aminoalkanols. Solvent systems containing monoethanolamine and/or beta-aminoalkanols are described in U.S. Pat. No. 5,108,660, which description is incorporated herein by reference.

Other suitable organic solvents include those polar organic solvents well-known in the detergency art for use in alkaline liquid hard-surface cleaning compositions. These other solvents are preferably polar organic solvents with good cleaning activity. These solvents can be any of the known "degreasing" solvents used in, for example, the dry cleaning industry, in the hard-surface cleaner industry and the metalworking industry. Many of these polar organic solvents comprise hydrocarbon or halogenated hydrocarbon moieties of the alkyl or cycloalkyl type, and have a boiling point well above room temperature, i.e., above about 20° C. (68° F.).

The formulator of the alkaline liquid composition herein will be guided in the selection of the organic solvent partly by the need to provide good grease-cutting properties, and partly by aesthetic considerations. For example, kerosene hydrocarbons function quite well for grease cutting but can be malodorous. Kerosene must be exceptionally clean before it can be used, even in commercial situations. For home use, where malodors would not be tolerated, the formulator would be more likely to select solvents which have a relatively pleasant odor, or odors which can be reasonably modified by perfuming.

The $C_6$–$C_{14}$ alkyl aromatic solvents, especially the $C_6$–$C_9$ alkyl benzenes, preferably octyl benzene, exhibit excellent grease removal properties and have a mild, pleasant odor. Likewise, the olefin solvents having a boiling point of at least about 100° C. (212° F.), especially alpha-olefins, preferably 1-decene or 1-dodecene, are excellent grease removal solvents.

Generically, the glycol ethers useful herein have the formula $R_{17}O(R_{18}O)_mH$ wherein each $R_{17}$ is an alkyl group which contains from about 3 to about 8 carbon atoms, each $R_{18}$ is either ethylene or propylene, and m is a number from 1 to about 3. The most preferred glycol ethers are selected from the group of monopropyleneglycol monopropyl ether, dipropyleneglycol monobutyl ether, monopropyleneglycol monobutyl ether, diethyleneglycol monohexyl ether, monoethyleneglycol monohexyl ether, monoethyleneglycol monobutyl ether, and mixtures thereof.

A preferred organic solvent for use in the composition herein are diols having from 6 to about 16 carbon atoms in their molecular structure. The diols are especially preferred because, in addition to good grease cutting ability, they impart to the composition an enhanced ability to remove calcium soap soils from surfaces such as bathtub and shower stall walls. The diols containing 8–12 carbon atoms are preferred. The most preferred diol solvent is 2,2,4-trimethyl-1,3-pentanediol.

Solvents such as pine oil, orange terpene, benzyl alcohol, n-hexanol, phthalic acid esters of $C_{1-4}$ alcohols, butoxy propanol, Butyl Carbitol ® and 1(2-n-butoxy-1-methylethoxy)propane-2-ol (also called butoxy propoxy propanol or dipropylene glycol monobutyl ether), hexyl diglycol (Hexyl Carbitol ®), butyl triglycol, diols such as 2,2,4-trimethyl-1,3-pentanediol, and mixtures thereof, can be used. The butoxy-propanol solvent should have no more than about 20%, preferably no more than about 10%, more preferably no more than about 7%, by weight of the secondary isomer in which the butoxy group is attached to the secondary atom of the propanol for improved odor.

Organic solvents with little or no cleaning action can also be used in the composition herein. Examples of such solvents include methanol, ethanol, isopropanol, ethylene glycol, propylene glycol, and mixtures thereof.

Alkalinity

The alkaline liquid composition of the present invention is formulated to have a pH of from about 8.5 to about 13, preferably from about 9.7 to about 12, more preferably from about 9.7 to about 11.5. The alkalinity contributes to grease cleaning properties of the composition. The requisite pH can be obtained and maintained by the use of known alkaline materials and buffer systems.

A preferred buffer system for use in the composition comprises monoethanolamine and/or beta-aminoalkanols and, optionally, but preferably, cobuffer and/or alkaline material selected from the group of ammonia, other $C_2$–$C_4$ alkanolamines, alkali metal hydroxides, silicates, borates, carbonates, bicarbonates, and mixtures thereof. The preferred cobuffering/alkalinity materials are alkali metal hydroxides. As described hereinbefore, the monoethanolamine and/or beta-aminoalkanols can also act as cleaning solvents within the composition at pH values above about 11.0.

Dry formulation

Optionally, the composition of the present invention can be prepared as a dry formulation, which comprises:

a) from about 10% to about 40%, preferably from about 12% to about 30%, more preferably from about 15% to about 20%, by weight of the selected $C_4$–$C_7$ dicarboxylate sequestrants described hereinbefore;

b) from about 5% to about 60%, preferably from about 15% to about 45%, more preferably from about 25% to about 35%, by weight of the quaternary ammonium disinfectants described hereinbefore;

c) from about 20% to about 80%, preferably from about 30% to about 70%, more preferably from about 45% to about 60%, by weight of the detergent surfactants described hereinbefore; and d) an alkalinity source in an amount sufficient to provide a pH of from about 8.5 to about 13 upon dilution at 20° C. (68° F.) with an aqueous liquid, said dilution comprising from about 5% to about 60% by weight of the dry formulation.

The key to the dry formulation, as with the alkaline liquid formulation described hereinbefore, is the combination of a quaternary ammonium disinfectant and selected dicarboxylate sequestrants. Upon dilution with an aqueous solvent (e.g., deionized water, tap water, aqueous organic diluents), the dry formulation is transformed into an alkaline liquid hard-surface cleaning and disinfecting composition with cleaning, disinfecting, filming/spotting and stability characteristics similar to that of the alkaline liquid composition described hereinbefore.

EXAMPLES

The hard-surface cleaning compositions of the present invention are illustrated by the following example. Values are weight percents unless otherwise specified.

| Ingredient | Formula A (control) | Formula B (dilute) | Formula C (concentrate) | Formula D (dry) |
|---|---|---|---|---|
| Isopropanol | 6.00 | 6.00 | 30.00 | 00 |
| Butoxypropanol | 3.00 | 3.00 | 15.00 | 00 |
| Monoethanolamine | 0.50 | 0.50 | 2.5 | 00 |
| VarionCAS Sulfobetaine | 0.16 | 0.16 | 0.80 | 55 |
| *Quaternary ammonium disinfectant | 0.0 | 0.10 | 0.50 | 15 |
| Tartaric acid | 0.0 | 0.50 | 2.5 | 30 |
| Added water | Balance | Balance | Balance | 00 |
| pH | 10.8 | 10.8 | 9.8 | — |

*mixture of n-alkyl dimethyl ethylbenzyl ammonium chloride and n-alkyl dimethyl benzyl ammonium chloride Formulas B, C, and D are dilute, concentrate and dry compositions, respectively, of the present invention. Formula A is a typical alkaline hard surface cleaning composition. The following tests were used to evaluate the performance of Formulas A, B and C.

Preparation of Soiled Panels

Enamel splash panes are selected and cleaned with a mild, light duty liquid cleanser, then cleaned with isopropanol, and rinsed with distilled or deionized water. A specified amount (0.05–0.75 gm/plate) of greasy particulate soil is weighed out and placed on a sheet of aluminum foil. The greasy-particulate soil is a mixture of about 77.8% by weight of commercial vegetable oils and about 22.2% by weight of particulate soil composed of humus, fine cement, clay, ferrous oxide, and carbon black. The soil is spread out with a spatula and rolled to uniformity with a standard 3-inch wide, one quarter inch nap, paint roller. The uniform soil is then rolled onto the clean enamel panels until an even coating is achieved. The panels are then placed in a preheated oven and baked at 130°–150° C. (266° to 302° F.) for 35–90 minutes. Panels are allowed to cool to room temperature and can either be used immediately, or aged for one or more days. The aging produces a tougher soil that typically requires more cleaning effort to remove.

Soil Removal

A Gardner Straight Line Washability Machine is used to perform the soil removal. The machine is fitted with a carriage which holds a weighted cleaning implement. The cleaning implements are clean cut sponges. Excess water is wrung out from the sponge and 1-10 grams of product are uniformly applied to one surface of the sponge. The sponge is fitted into the carriage on the Gardner Machine and the cleaning test is run.

Cleaning Scale

This method evaluates the cleaning efficiency of test products and compares them to that of a reference product. The number of strokes (Gardner Machine) necessary to remove 95–99% of the soil is obtained. Then the following formula is used to rate cleaning performance {"Soil Removal" Scale Rating=[1/# strokes for test product]×100×# strokes for reference product}. This yields a value of 100 for the reference product. If the test product requires fewer strokes than the reference product, the test product will have a Scale Rating value>100. If the test product requires more strokes than the standard it will have a Scale Rating value<100. Formula A was used as the reference product.

Soil Removal Scale Rating Data

| Formula | Mean Rating* |
|---|---|
| A | 100 |
| B | 170 |
| C | 170 |

4 test repetitions, soiled panels aged 2 days

The difference between mean ratings of 100 and 170 is statistically significant at 95% confidence. Therefore, formulas B and C, which contain both tartaric acid and a quaternary ammonium disinfectant, are clearly better than Formula A, which contains neither tartaric acid nor a quaternary ammonium disinfectant, in removing soil.

Filming/Streaking Test on Glass Panels

A glass window pane approximately 18×23 inches is cleaned with a mild detergent to remove any accumulated soil. It is then cleaned repeatedly with a blend of isopropanol and propylene glycol monobutylether until no visible residue remains on the glass. The glass is then divided into four equal sized quadrants with masking tape. Two milliliters of each test product are uniformly applied to a quartered paper towel and applied to a specified quadrant. The wet paper towel is rubbed uniformly throughout the quadrant and the residue is allowed to evaporate.

Panelists are then called upon to grade filming/streaking of each glass panel on the following absolute numerical (0–7) scale.

0: none (no visible filming/streaking)
1: mild-none
2: mild
3: mild-moderate

4: moderate
5: moderate-heavy
6: heavy (heavy filming/streaking)

| Filming/Streaking on Glass Panels | |
|---|---|
| Panel Score Unit (psu) Ratings | |
| Formula pair | Mean psu Rating* |
| A | 3.0 |
| B | 0.7 |
| C | 0.75** |

*based on 3 test repetitions
**diluted with 14gpg water to a Formula A/B concentration The difference between mean psu ratings of 3.0 and 0.7 (and between 3.0 and 0.75) is statistically significant at 95% confidence. Therefore, formulas B and C, which contain both tartaric acid and a quaternary ammonium disinfectant, are clearly better than Formula A, which contains neither tartaric acid nor a quaternary ammonium disinfectant, in minimizing filming/streaking on glass surfaces.

Germicidal Effectiveness

The germicidal effectiveness of Formula B against the organisms *Staphylococcus aureus, Pseudomonas Aeruginosa* and *Salmonella chloreasuis* was determined according to the method described in "Official Methods of Analysis of the Association of Official Analytical Chemists" (AOAC), 12th Ed. (1975), pages 59–60. The evaluation was performed on a use dilution of 1 part of Formula B diluted with 64 parts of water. Formula B received a "Germicidal" rating as to each of the above described organisms. Thus, the disinfectancy properties of the quaternary ammonium compound in Formula B were not "inactivated" by the tartaric acid in the composition.

What is claimed:

1. An alkaline liquid, hard-surface cleaning and disinfecting composition, which consists essentially of:

a) from 0.001% to 2.5% by weight of at least one hard water sequestrant having the formula

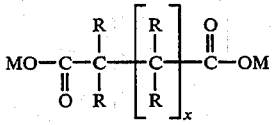

wherein each R group is selected from the group consisting of hydrogen and hydroxyl groups; and wherein at least two R groups are hydroxyl; M is selected from the group of hydrogen, ammnonium and alkali metals; and X is 1;

b) from 0.005% to 0.5% by weight of a quaternary ammonium disinfectant having the formula:

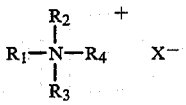

wherein at least one of $R_1$, $R_2$, $R_3$ or $R_4$ is benzyl or $C_1$–$C_4$ alkyl benzyl and the remaining R groups are selected from the group of hydrogen or alkyl; and wherein $X^-$ is selected from the group consisting of halogen, sulfate or nitrate;

c) from about 0.001% to about 15% by weight of a detergent surfactant selected from the group consisting of zwitterionic surfactant, nonionic surfactant and mixtures thereof;

d) a pH of from about 8.5 to about 13.0,;

e) from about 15% to about 98%, by weight of water; and f) from 0 to about 20% by weight of an organic solvent having a hydrogen bonding parameter of less than 7.7.

2. A composition according to claim 1 wherein said quaternary ammonium compound is selected from the group consisting of an alkyl ($C_{12}$–$C_{18}$) dimethyl benzyl ammonium chloride and N-alkyl ($C_{12}$–$C_{18}$) benzyl dimethyl ammonium chloride, and mixtures thereof.

3. The composition of claim 1 wherein the hard water sequestrant is selected from the group of tartaric acid, dihydroxytartaric acid and mixtures thereof.

4. The composition of claim 1 wherein said composition comprises from about 0.5% to about 3% by weight of the detergent surfactant.

5. The composition according to claim 1 wherein the pH is from about 9.7 to about 11.5.

6. The composition according to claim 1 wherein said composition comprises from about 1% to about 20% of an organic solvent having a hydrogen bonding parameter of from about 3 to about 6.

7. The composition according to claim 6 wherein the organic solvent comprises monoethanolamine.

8. The composition according to claim 1 wherein said composition comprises from about 45% to about 95% water.

9. The composition according to claim 1 wherein M is an alkali metal.

10. A dry detergent formulation for use in cleaning and disinfecting hard-surfaces, which consists essentially of:

a) from about 10% to about 30% by weight of at least one hard water sequestrant having the formula

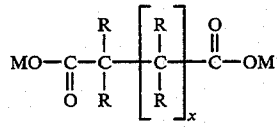

wherein each R group is selected from the group consisting of hydrogen and hydroxyl groups; and wherein at least two R groups are hydroxyl; M is selected from the group of hydrogen, ammonium and alkali metal; and X is 1;

b) from 5% by 15% by weight of a quaternary ammonium disinfectant having the formula

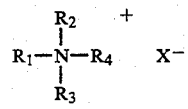

wherein at least one of $R_1$, $R_2$, $R_3$ or $R_4$ is benzyl or $C_1$–$C_4$ alkyl benzyl and wherein the remaining R groups are selected from the group of hydrogen or alkyl; and wherein $X^-$ is selected from the group consisting of halogen, sulfate or nitrate;

c) from about 20% to about 80% by weight of a detergent surfactant selected from the group of zwitterionic surfactant, nonionic surfactant and mixtures thereof; and d) an alkalinity source sufficient to provide a pH of from about 8.5 to about 13.0 when said composition is diluted with water, wherein said diluted composition contains from about 0.005% to about 50% by weight of dry detergent formulation, and wherein said pH is measured at 68° F.

11. The composition of claim 10 wherein the hard water sequestrant is selected from the group of tartaric acid, dihydroxytartaric acid and mixtures thereof.

12. The composition of claim 10 wherein said composition comprises from about 30% to about 70% by weight of the detergent surfactant.

13. The composition according to claim 1 wherein M is hydrogen.

14. A composition according to claim 10 wherein said quaternary ammonium compound is selected from the group consisting of an alkyl ($C_{12}$–$C_{18}$) dimethyl benzyl ammonium chloride and N-alkyl ($C_{12}$–$C_{18}$) benzyl dimethyl ammonium chloride, and mixtures thereof.

* * * * *